US005402163A

United States Patent [19]

Maximovsky et al.

[11] Patent Number: 5,402,163

[45] Date of Patent: Mar. 28, 1995

[54] JET PRINT HEAD

[75] Inventors: Sergei N. Maximovsky; Grigory A. Radutsky, both of Moscow, Russian Federation

[73] Assignee: Samsung Electronics Co. Ltd., Seoul, Rep. of Korea

[21] Appl. No.: 949,486

[22] PCT Filed: Apr. 26, 1991

[86] PCT No.: PCT/SU91/00080

§ 371 Date: Oct. 20, 1992

§ 102(e) Date: Oct. 20, 1992

[87] PCT Pub. No.: WO92/14611

PCT Pub. Date: Sep. 3, 1992

[30] Foreign Application Priority Data

Feb. 22, 1991 [RU] Russian Federation ..... 4910619

[51] Int. Cl.[6] ..... B41J 2/06

[52] U.S. Cl. ..... 347/54

[58] Field of Search ..... 346/75, 140 R; B41J 2/06, 2/14; G01D 15/18; 347/44, 54, 55

[56] References Cited

U.S. PATENT DOCUMENTS 4,023,180 5/1977 Zenner ..... 346/75

4,057,807 11/1977 Fischbeck et al. ..... 346/140 R

FOREIGN PATENT DOCUMENTS 0212943 3/1987 European Pat. Off. ..... B41J 3/04

0214720 3/1987 European Pat. Off. ..... B41J 3/04

90/11189 10/1990 WIPO .

*Primary Examiner*—Benjamin R. Fuller

*Assistant Examiner*—Alrick Bobb

*Attorney, Agent, or Firm*—Keck, Mahin & Cate

[57] ABSTRACT

A jet print head (1) comprises a chamber (2) for current conductive ink (6) and an ink discharge port (3) to express ink onto the information carrier (4). The discharge port (3) has a group array of parallel rows of orifices (5) obtained in the form of flow-through openings communicating with the chamber (2) and represented by a multilaminate structure established on an underlay (8) and having layers forming electrodes (7) which are common for each row of orifices (5), and individual electrodes (10) for every orifice (5), produced as an integral whole together with the current conductive bar (12), and a magnetic layer (9) placed between them. The energy signal pulse sent to the electrodes (7,10) creates electro-dynamic force by virtue of which an ink drop is discharged from the given capillary tube to fall onto the information carrier (4).

1 Claim, 1 Drawing Sheet

JET PRINT HEAD

FIELD OF INVENTION

The invention relates to printing devices, and particularly, to a jet print head for such devices.

PRIOR ART

Known in the prior art is a print head supplying electro-conductive ink onto an information carrier by virtue of electro-dynamic force, comprising an ink chamber with an ink discharge port, having a plurality of parallel tubes of sufficiently large diameter which represent essentially capillary orifices. Each orifice has a pair of electrodes entering the orifice from the diametrically opposite sides of the tube, perpendicular to its axis. The head is embraced by a permanent horse-shoe magnet arranged so that all openings are permeable to a magnetic field created by the magnet (see U.S. Pat. No. 4,023,180). Current is passed through electricity conductive ink and interacts with the magnetic field of the permanent magnet once an electrical signal pulse is applied to the pair of electrodes. As a result, electromagnetic force is developed, causing a drop of ink to be emitted from the capillary tube. The construction design of such a print head is quite complex because it requires the electrodes to be inserted into the capillary tubes and strict orientation of them in relation to the capillary tubes axes. Violation of this strict orientation is responsible for poor quality of printing. Apart from that, no sound connection of electrodes with electro-conductive bars is, in fact, possible. And, finally, to ensure reliable discharge of ink drops from the head orifice, every capillary tube should operate in equal conditions, i.e. the magnetic field in the zone of electrodes should be the same, and equally the same should be the force of an electrical signal pulse passing through them. When a horse-shoe magnet is used, the magnetic field in the center will be substantially weaker than on the periphery, which fact tells substantially the quality of printing because it affects the formation of ink drops discharged from the capillary tube. It will be noted in the meanwhile that to create an essentially homogenous field throughout the whole print head surface, the horse-shoe magnet must be many times larger than the area covered by the capillary tubes.

Known in the prior art is a jet print head comprising a chamber for electro-conductive ink equipped with an ink discharge port to express ink onto the information carrier. The ink discharge port comprises a multilaminate structure formed on an underlay with a group array of parallel rows of orifices made in the same structure in the form of capillary openings communicating with the inside chamber storage. Each given row of orifices has an electrode of the same polarity which is common for this row, and every orifice of this group has an individual electrode of opposite polarity, and all the electrodes are placed on one and the same side of the underlay facing the chamber in the same plane directed perpendicular to the axis of orifices, and make one layer of the multilaminate structure. The electrodes of different rows are electrically isolated from each other. This discharge port also has electro-conductive bars of individual electrodes which exist in the plane parallel to that of electrodes, and are separated from them by the dielectric layer, oriented or patterned on the lines criss-crossing the other lines which connect the individual electrodes of each group at a 90 degree angle, and joined to the individual electrodes of relevant groups by crosspieces passing through the dielectric layer. The permanent magnet of such head is represented by the magnetic layer disposed on the underlay parallel to the plane of the electrode groups from the side opposite to ink or colour liquid.

The structure of this head reveals a number of useful results, for example, in simplification of its design due to the reduced number of electric current feeders (just one bar for a row of orifices), and also in higher quality of printing owing to greater reliability of expressing drops from the orifices due to uniform field stress exerted by the magnetic layer. Apart from that, such head structure permits making an ink discharge port with practically an unlimited number of orifices.

Given the head which secures the creation of a uniform magnetic field for each orifice by way of introducing a magnetic layer into the structure of the discharge port, energy expenditures involved in the creation of electro-dynamic force which would be sufficient to express drops from the capillary tubes, are in actual fact too large because the electric current which flows through the colour liquid (ink) present in the capillary tube, is crossing not the magnetic layer, but the component field created thereby. This is a result of the electrodes and the magnetic layer being placed on different sides of the underlay. Apart from that, rather complex is the connection of the individual electrodes to the electric current conductive crosspieces in the said head, which creates substantial technological difficulties in the manufacture of the head.

DESCRIPTION OF THE INVENTION

The principal object of the invention consists in providing an ink discharge port of the jet print head so that with a uniform stress of the magnetic field for each orifice, there is an assured intersection of lines of the electric field created by the current which flows through the liquid (ink) present in the orifice, with lines of the magnetic field generated by the magnetic layer, in the zone of their maximum concentration.

The object of the invention is achieved by a jet print head comprising a chamber for electro-conductive ink equipped with an ink discharge port to express ink onto the information carrier, said discharge port comprising a multi-laminate structure with a group array of parallel rows of orifices obtained in the same structure in the form of capillary openings communicating with the inside chamber storage, and with an underlay contacting a magnetic layer, both sandwiched between the dielectric layers, with electrodes of the same polarity which are common for each row of orifices, and individual electrodes of opposite polarity for every orifice, with electro-conductive bars which exist in the plane parallel to that of the common electrodes and are connected with each other for each row of orifices, the common and individual electrodes are placed, according to the invention, on different layers located in both directions away from an underlay with a magnetic layer, said individual electrodes for each row of orifices being produced as an integral whole together with the electric current conductive bar which corresponds to the given row of orifices.

Placement of the individual and common electrodes on different sides of the underlay permits location of a magnetic layer between the planes of their disposition, which ensures the intersection of the electric current of the zone of maximum concentration created by the magnetic layer of the field, while the current is flowing through the liquid in the capillary tube, and thus to reduce energy expenditure required to create electro-dynamic force which would be sufficient for expressing ink drops from the capillary tube. Apart from that, the execution of the individual electrodes of the same name in all rows of orifices as an integral whole together with the electric current conductive bars, which is possible only when they exist in the plane away from that of the common electrodes disposition, allows to considerably simplify the construction of the head and facilitate its manufacture.

BRIEF DESCRIPTION OF DRAWINGS

Below there is a more detailed description of the device with reference to the drawings of specific embodiments, where.

PREFERRED EMBODIMENT OF THE INVENTION

Figure 1:
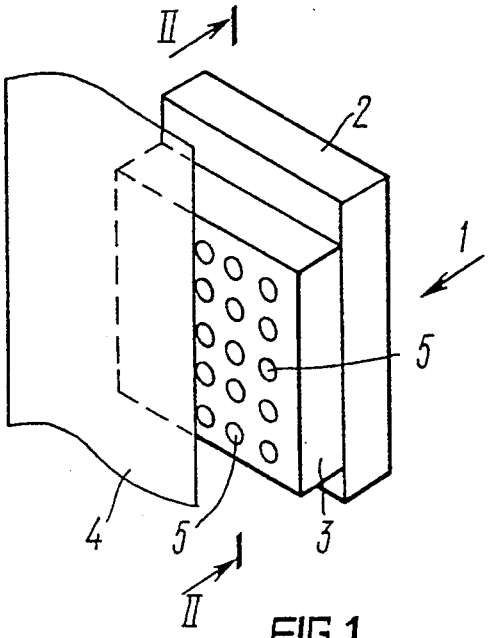
FIG. 1 is a general view of the jet print head according to the invention.
Figure 2:
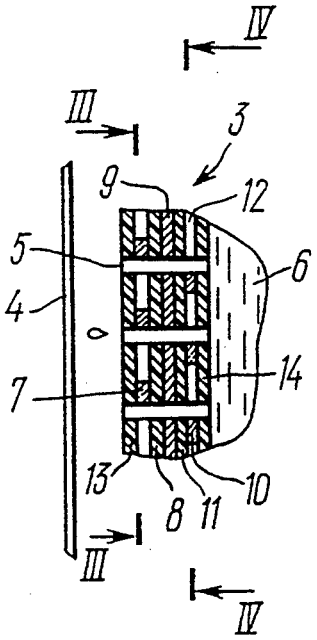
FIG. 2—a cross-section of FIG. 1 along line II—II.
Figure 3:
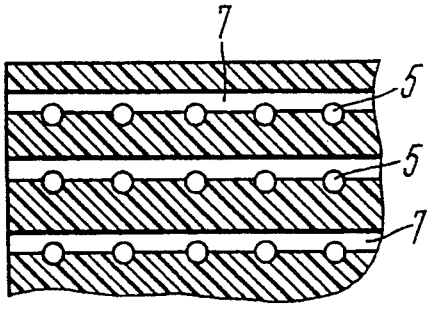
FIG. 3—a cross-section of FIG. 2 along line III—III.
Figure 4:
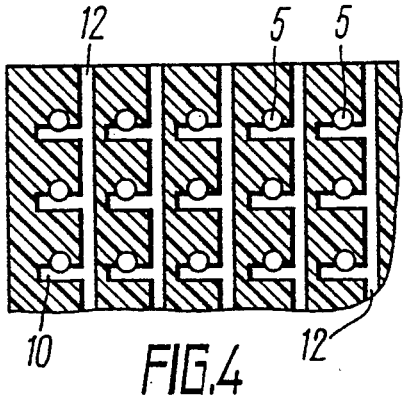
FIG. 4—a cross-section of FIG. 2 along line IV—IV.

As is evident from FIG. 1, the jet print head generally marked by position 1, has a chamber 2 which is filled with electric current conductive colour liquid (ink), and an ink discharge port 3 to supply ink onto the information carrier 4. The discharge port 3 comprises a multilaminate structure with a group array of parallel rows of orifices 5 made in the same structure in the form of flow-through openings which are communicating with the chamber 2 and which axes are directed perpendicular to the surface of colour liquid (ink) 6 (FIG. 2). Each row of orifices 5 has an electrode 7 which is common for all orifices 5 of this row, the total number of the said electrodes being equal to the number of rows of orifices 5, for example, horizontal—for the design presented in FIG. 1. The common electrodes form continuous stripes of electro-conductive material placed on the outer side (facing the information carrier 4) of the underlay 8 of dielectric material. The opposite side of the underlay 8 has a magnetic layer 9. Each orifice 5 also has an individual electrode 10 which polarity is opposite to that of the common electrodes 7. The said electrodes 10 exist in the plane that is parallel to the plane of the common electrodes 7 disposition, on the inner side (facing the chamber 2) of the underlay 8. For every row of orifices 5, they form intermissive stripes of electro-conductive material placed on the dielectric layer 11 to cover the magnetic layer 9, and executed as an integral whole together with the electro-conductive bars 12 which correspond to each row of orifices. Thus, the common electrodes 7 and the individual electrodes 10 are located in different planes directed perpendicular to the axis of orifice 5 openings, and make two layers of the multilaminate structure of the ink discharge port 3, the said two layers being placed in different directions away from the magnetic layer 9 and protected by the layers 13 and 14 of the dielectric.

The proposed jet print head functions as follows.

Once the energy signal pulse is sent to one of the common electrodes 7 as well as to one of the electro-conductive bars 12 through the current conductive ink 6, the current is passed through the capillary tube of the orifice 5. The electric field lines set up by this current, cross the magnetic field lines created by the layer 9, in the zone of their maximum concentration. The interaction of the electric current with the layer 9 effected magnetic field results in creation of electro-dynamic force by virtue of which an ink drop is discharged from the given capillary tube to fall onto the information carrier 4. Similarly, the drops of ink 6 are transferred from other orifices 5 of the head 1 to the carrier 4.

This embodiment of the jet print head not only allows to obtain simplification of its construction by way of executing the individual electrodes 10 and the current conductive bars 12 joined to the said electrodes, as an integral whole, and to facilitate the manufacture by excluding the operation of connecting the electrodes 10 with the current conductive bars 12 by means of cross-pieces, but also to substantially reduce energy expenditure required to produce electro-dynamic force to express drops from the orifices 5 on account of effective utilization of the magnetic field 9 located on the route of the ink 6 high-energy particles movement between the electrodes 7 and 10 of each orifice 5.

INDUSTRIAL EMPLOYMENT

The proposed jet print head allows to perform contactless printing of information on the carriers of different types: paper, film etc. It follows, then, that the invention may be employed in polygraphic industry, in the manufacture of letter-and-figure foundries and other data typing equipment, in the electronic computer industry, packing and postal sevices, and other spheres of business pertaining to printing commands.

What is claimed is:

1. A jet print head comprising:

a storage chamber for storing current conductive ink; and an ink discharge port to express ink onto an information carrier, said ink discharge port being a multilaminate structure with (a) a group array of parallel rows and columns of capillary openings which communicate with an inside of said storage chamber, (b) an underlay, (c) dielectric layers between which said underlay is placed, (d) a magentic layer in contact with said underlay, (e) common electrodes of a same polarity, in a first plane on one side of said underlay, for each of said rows of capillary openings, (f) individual electrodes of opposite polarity for each of said capillary openings and existing in a second plane on another side of said underlay parallel to the first plane and connected to one another for each of said rows of capillary openings and (g) electric current conductive bars connecting the individual electrodes for each of said capillary opening in each of said rows of capillary openings to one another, the common and individual electrodes being located on opposite sides of said underlay and said magnetic layer, said individual electrodes in each of said rows of capillary openings being produced, as an integral unit, together with the electric current conductive bars of each of said rows.

* * * * *